US010299590B2

(12) United States Patent
Olson et al.

(10) Patent No.: US 10,299,590 B2
(45) Date of Patent: May 28, 2019

(54) SHELF FRAME ASSEMBLY SYSTEM AND METHOD

(71) Applicant: INTERMETRO INDUSTRIES CORPORATION, Wilkes-Barre, PA (US)

(72) Inventors: Jeffrey C. Olson, Dallas, PA (US); David A. Reppert, Kingston, PA (US)

(73) Assignee: INTERMETRO INDUSTRIES CORPORATION, Wilkes-Barre, PA (US)

( * ) Notice: Subject to any disclaimer, the term of this patent is extended or adjusted under 35 U.S.C. 154(b) by 177 days.

(21) Appl. No.: 15/510,886

(22) PCT Filed: Sep. 17, 2015

(86) PCT No.: PCT/US2015/050665
§ 371 (c)(1),
(2) Date: Mar. 13, 2017

(87) PCT Pub. No.: WO2016/044580
PCT Pub. Date: Mar. 24, 2016

(65) Prior Publication Data

US 2018/0206639 A1 Jul. 26, 2018

Related U.S. Application Data

(60) Provisional application No. 62/052,747, filed on Sep. 19, 2014.

(51) Int. Cl.
*A47B 96/02* (2006.01)
*A47B 47/04* (2006.01)

(52) U.S. Cl.
CPC ..... *A47B 96/021* (2013.01); *A47B 47/04* (2013.01)

(58) Field of Classification Search
CPC ..... A47B 57/265; A47B 57/545; A47B 57/58; A47B 57/581; A47B 57/583; A47B 57/588; A47B 96/021; A47B 47/04
See application file for complete search history.

(56) References Cited

U.S. PATENT DOCUMENTS 4,323,319 A 4/1982 Adams
4,958,953 A 9/1990 Charondiere
(Continued)

FOREIGN PATENT DOCUMENTS

CN 2705652 Y 6/2005
CN 101646875 A 2/2010
(Continued)

OTHER PUBLICATIONS

International Search Report and Written Opinion or the ISA for PCT/US2015/050665, ISA/US, Alexandria. Virginia, dated Jan. 29, 2016.
(Continued)

*Primary Examiner* — Matthew W Ing
(74) *Attorney, Agent, or Firm* — Harness, Dickey & Pierce, P.L.C.

(57) ABSTRACT

A shelf frame assembly is provided. The shelf frame assembly can include a beam connector, a length beam, and an end beam. The beam connector can have a first flexible protrusion and a second flexible protrusion. The first flexible protrusion may be an interior beam indexing feature. The length beam can be configured to receive the first flexible protrusion. The end beam can be configured to receive the second flexible protrusion.

14 Claims, 5 Drawing Sheets

(56) References Cited

U.S. PATENT DOCUMENTS

| | | | | |
|---|---|---|---|---|
| 5,695,081 | A * | 12/1997 | Alkalay | A47B 47/04 108/147.12 |
| 7,014,267 | B1 | 3/2006 | Nagar | |
| 7,186,050 | B2 | 3/2007 | Dean et al. | |
| 2004/0104319 | A1 | 6/2004 | Dean et al. | |
| 2008/0203042 | A1* | 8/2008 | Felsenthal | A47B 47/027 211/153 |
| 2008/0302748 | A1 | 12/2008 | Tsai | |
| 2009/0242500 | A1* | 10/2009 | Li | A47F 7/26 211/116 |
| 2011/0284704 | A1* | 11/2011 | Pryor | A47B 9/14 248/188.5 |
| 2013/0098857 | A1 | 4/2013 | Jarvis et al. | |

FOREIGN PATENT DOCUMENTS

| | | | |
|---|---|---|---|
| EP | 0340122 | A1 | 11/1989 |
| EP | 0959723 | B1 | 12/2002 |
| FR | 2945843 | A1 | 11/2010 |
| GB | 1546432 | A | 5/1979 |
| GB | 2450947 | A | 1/2009 |
| SE | 507082 | C2 | 3/1998 |

OTHER PUBLICATIONS

International Preliminary Report on Patentability for PCT/US2015/050665, IPEA/US, Alexandria, Virginia, completed Dec. 7, 2016.
Supplementary European Search Report of EPO for EP15842072; European Patent Office, Munich, Germany; dated Jan. 25, 2018.

* cited by examiner

SHELF FRAME ASSEMBLY SYSTEM AND METHOD

This application is a 371 National Phase of PCT/US2015/050665, published as WO 2016/044580 on Mar. 24, 2016, which claims the benefit of U.S. Provisional Application No. 62/052,747, filed on Sep. 19, 2014. The entire disclosures of the above applications are incorporated herein by reference.

FIELD

Background

This section provides background information related to the present disclosure which is not necessarily prior art.

Known plastic shelf frames (see, e.g., http://www.metro-.com/shelving/plastic-shelving) are assembled, using two molded end-beams, two length beams, four glue dam sleeves, four "shots" of hot melt glue, and four stainless steel screws. The glue dam sleeves are assembled to the two length beams. The beams are inserted into one or more sockets of the end beams. The frame assembly is inserted into an automated assembly fixture that holds the components, while injecting the joints with glue. A second fixture installs the four stainless steel screws.

The glue dams are intended to eliminate the gap caused by drafted surfaces of the one or more end beam sockets and create a clean interface between the two components. The glue dams are also intended to prevent the injected hot melt glue from seeping out of the joint, and the need for subsequent cleanup of glue flash. The glue dams also contain dovetail features that interface with the hardened glue to secure them in place. Though adequate, this shelf frame and assembly method can be improved. Accordingly, the present disclosure provides a permanent, corrosion resistant, and cost effective shelf frame system and assembly method.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DESCRIPTION

Example embodiments will now be described more fully with reference to the accompanying drawings.

Figure 1A:
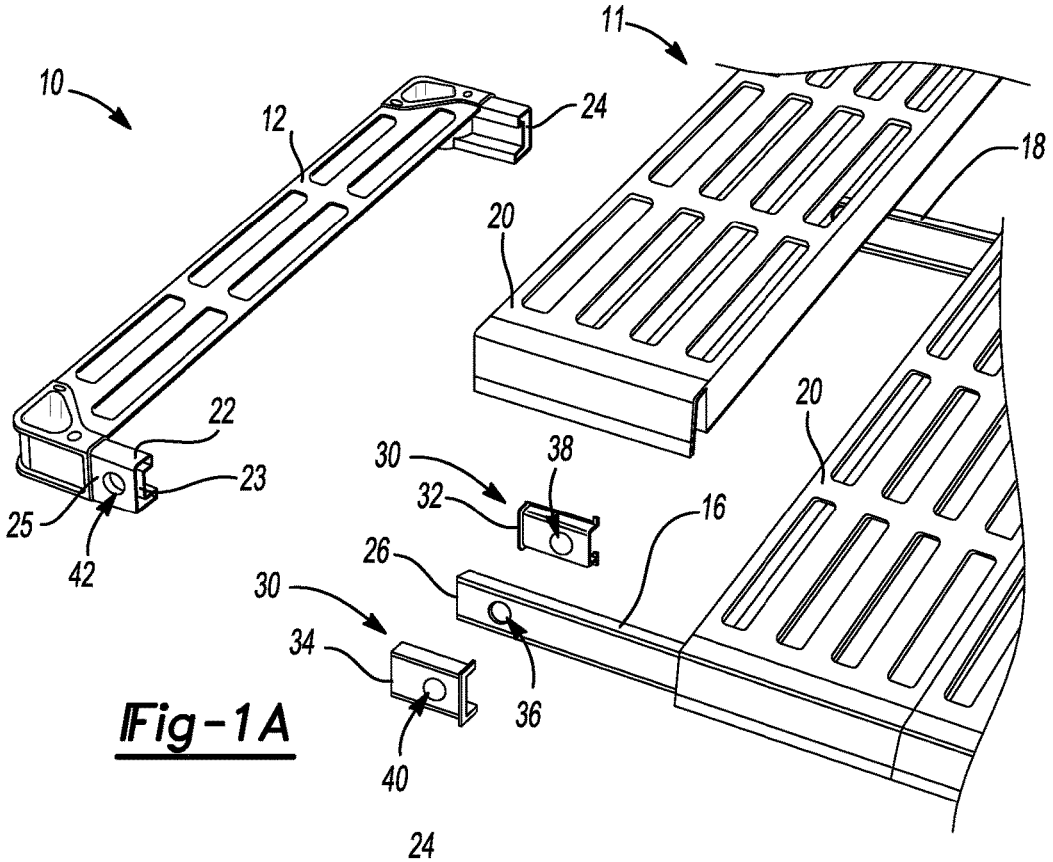
FIG. 1A is an exploded perspective view of a portion of a shelf frame including a beam connector according to the principle of the present disclosure.
Figure 1B:
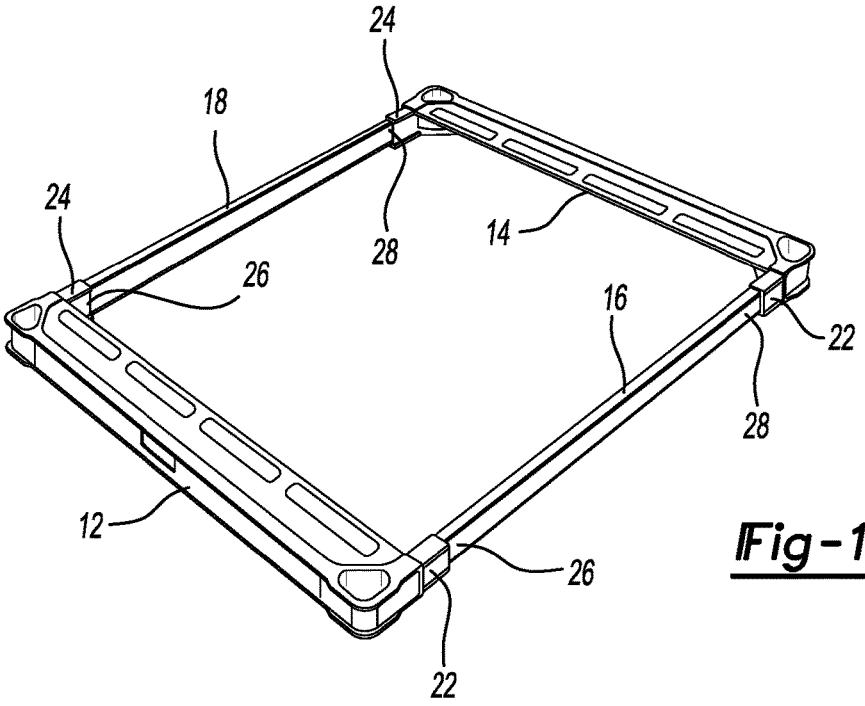
FIG. 1B is a perspective view of an assembled shelf frame according to the principles of the present disclosure.

With reference to FIGS. 1A and 1B, a shelf frame 10 includes a first end beam 12, a second end beam 14, a first length beam 16, and a second length beam 18. A shelf 11 includes the shelf frame 10 and a plurality of shelf mats 20. Each of the first end beam 12 and the second end beam 14 includes a first coupling portion 22 and a second coupling portion 24. Each of the first length beam 16 and the second length beam 18 includes a first end 26 and a second end 28. In some implementations, the first coupling portion 22 and the second coupling portion 24 may be asymmetrical. Similarly, the first end 26 and the second end 28 may be asymmetrical. In another implementation, the first coupling portion 22 and the second coupling portion 24 may be symmetrical. Similarly, the first end 26 and the second end 28 may be symmetrical.

At least one of the first end 26 and the second end 28 is configured to receive a beam connector 30. According to one implementation, the beam connector 30 comprises a first connector portion 32 and a second connector portion 34. According to another implementation and with references to FIGS. 5A through 5D, the beam connector 30 comprises a single piece beam connector 31. While only one beam connector 30 is shown, the shelf frame 10 may alternatively include a plurality of beam connectors 30. For example, the shelf frame 10 may include one beam connector 30. In another implementation, the shelf frame 10 may include a beam connector 30 at one end of each of the first length beam 16 and the second length beam 18. In another implementation, the shelf frame 10 includes a beam connector 30 at each of the first end 26 and the second end 28 of each of the first length beam 16 and the second length beam 18. It is understood that any number of beam connectors 30 may be combined with any end of the first length beam 16 and the second length beam 18.

According to one implementation, each of the beam connectors 30 includes a first connector portion 32 and a second connector portion 34. For example, each of the first end 26 and the second end 28 includes a first receiving portion 36 and the first connector portion 32 includes a first flexible protrusion 38. The first receiving portions 36 are configured to receive the first flexible protrusion 38. In some embodiments, the first receiving portions 36 are openings in the first end 26 and the second end 28.

For example, the first receiving portion 36 of the first end 26 may be a hole with a first diameter passing through the first end 26. In some implementations, the hole is drilled into the first end 26 after the first length beam 16 is manufactured. It is understood, that a similar hole in the first end 26 of the second length beam 18 may also be drilled after the second length beam 18 is manufactured. Further, a hole in the second end 28 of either or both of the first length beam 16 and the second length beam 18 may also be drilled after the first length beam 16 and the second length beam 18 are manufactured.

The first flexible protrusion 38 is configured to be pressed into the first receiving portion 36. For example, the first flexible protrusion 38 may be a rounded protrusion that includes a proximal end and a distal end. The proximal end may have a diameter that is smaller than the first diameter and the distal end may have a diameter that is slightly larger than the first diameter.

The first flexible protrusion 38 is inserted into the first receiving portion 36. When the first flexible protrusion 38 is inserted into the first receiving portion 36, the first flexible protrusion 38 temporarily deforms to allow the distal end to pass through the first receiving portion 36. For example, the distal end of the first flexible protrusion 38 is deformed in order to pass through the first diameter of the first receiving portion 36. The first flexible protrusion 38 then returns to its original shape. In other words, the first flexible protrusion 38 temporarily deforms to allow the larger diameter of the distal end to pass through the first diameter of the first receiving portion 36. The larger diameter of the distal end is then restored once the distal end has passed through the first receiving portion 36. In this manner, the first flexible protrusion 38 is configured to resist withdrawal from the first receiving portion 36.

Each of the first connector portions 32 is configured to receive the second connector portions 34. For example, the first connector portion 32 is configured to be received by the first end 26, as described above. The first connector portion 32 is configured to receive the second connector portion 34. For example, the first connector portion 32 may be configured to fit inside of the second connector portion 34. In some implementations, the first connector portion 32 fixedly snaps into the second connector portion 34. Once the first connector portion 32 is fixedly snapped into the second connector portion 34, a tool may be required to remove the first connector portion 32 from the second connector portion 34.

Figure 2:
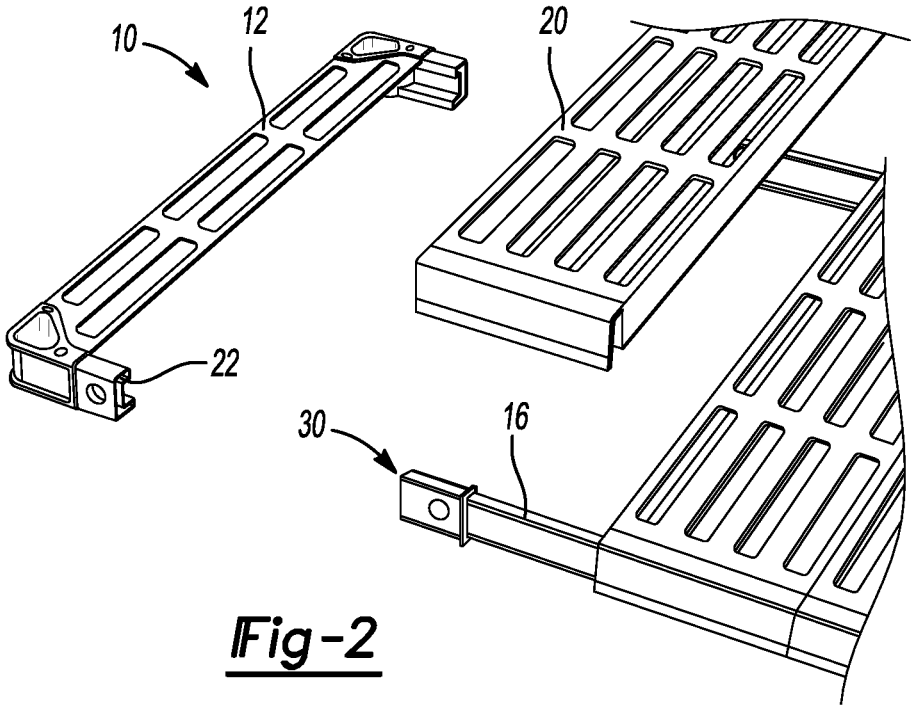
FIG. 2 is a perspective view of a partially assembled shelf frame including a plurality of shelf mats according to the principles of the present disclosure.

In some implementations, the first connector portion 32 is received by the first end 26, as described above, before the first connector portion 32 receives the second connector portion 34. In another implementation, the first connector portion 32 receives the second connector portion 34. In another implementation, the first flexible protrusion 38 snaps into a void behind the second flexible protrusion 40. For example, the second flexible protrusion 40 may be hollow. In other words, the back of the second flexible protrusion 40 is bored out and configured to receive the first flexible protrusion 38. As illustrated in FIG. 2, the first connector portion 32 and the second connector portion 34, referred to as the beam connector 30, is slid over the first end 26. The first flexible protrusion 38 is then received by the first receiving portion 36.

The second connector portion 34 includes a second flexible protrusion 40. The second flexible protrusion 40 includes properties similar to the first flexible protrusion 38. For example, the second flexible protrusion 40 includes a proximal end and a distal end. Each of the first coupling portion 22 and the second coupling portion 24 includes a second receiving portion 42. The second receiving portion 42 includes properties similar to the first receiving portion 36. For example, the second receiving portion 42 may be a hole with a second diameter passing through the first coupling portion 22. It is understood that the hole in the first coupling portion 22 may be molded during manufacturing of the first end beam 12. In another implementation, the hole may be drilled after the first end beam 12 is manufactured. It is understood that the second coupling portion 24, while not shown, includes a second receiving portion 42. Further, the second end beam 14 includes second receiving portion 42 in a first coupling portion 22 and a second coupling portion 24 of the second end beam 14. In some implementations, the second diameter is the same as the first diameter. In other implementations, the second diameter is not the same as the first diameter.

The second receiving portion 42 is configured to receiving the second flexible protrusion 40 in a manner similar to that described above with respect to the first receiving portion 36 receiving the first flexible protrusion 38. For example, the proximal end of the second flexible protrusion 40 includes a diameter that is smaller than the second diameter. Further, the distal end includes a diameter that is slightly larger than the second diameter.

The second flexible protrusion 40 is inserted into the second receiving portion 42. When the second flexible protrusion 40 is inserted into the second receiving portion 42, the second flexible protrusion 40 temporarily deforms to allow the distal end to pass through the second receiving portion 42. For example, the distal end of the second flexible protrusion 40 is deformed in order to pass through the second diameter of the second receiving portion 42.

The second flexible protrusion 40 then returns to its original shape. In other words, the second flexible protrusion 40 temporarily deforms to allow the larger diameter of the distal end to pass through the second diameter of the second receiving portion 42. The larger diameter of the distal end is then restored once the distal end has passed through the second receiving portion 42. In this manner, the second flexible protrusion 40 is configured to resist withdrawal from the second receiving portion 42.

In some implementations, the first coupling portion 22 and the second coupling portion 24 are flexible and rotate about an axis located near a distal end of the first coupling portion 22 and the second coupling portion 24. For example, the first coupling portion 22 includes a proximal end 23 and a distal end 25. The first coupling portion 22 is configured to flex about the distal end 25.

For example, the proximal end 23 may move in a direction away from the second coupling portion 24 while the distal end 25 remains stationary. The beam connector 30 may be inserted into the first coupling portion 22. The proximal end 23 flexes away from the beam connector 30 in response to the beam connector 30 being inserted into the first coupling portion 22.

The second flexible protrusion 40 snaps into the second receiving portion 42, as described above. The proximal end 23 returns to an original position in response to the second flexible protrusion 40 snapping into the second receiving portion 42. In this manner, the first coupling portion 22 may flex in order to snap the second receiving portion 42 onto the second flexible protrusion 40. It is understood that while only the first coupling portion 22 is described, the principles included herein apply to the second coupling portion 24.

Figure 3:
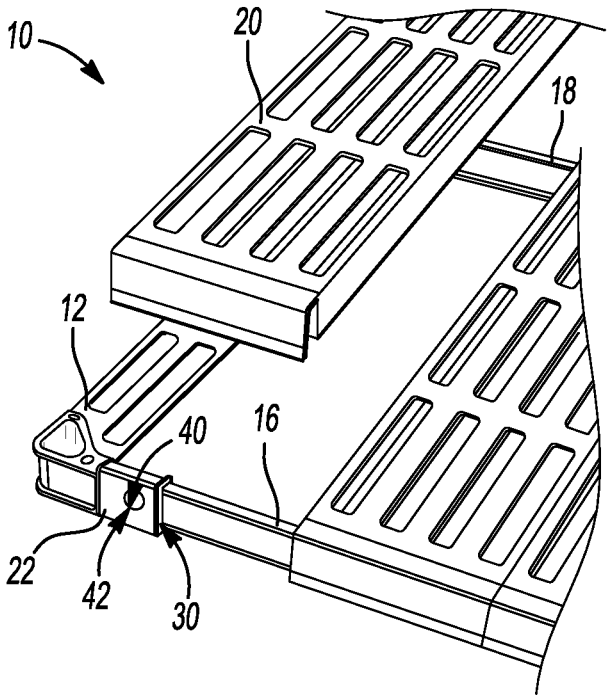
FIG. 3 is a perspective view of a partially assembled shelf frame of FIG. 2.

As illustrated in FIG. 3, the first end beam 12 is fixedly coupled to the first length beam 16 by one of the beam connectors 30, as described above. Further, the first end beam 12 is fixedly coupled to the second length beam 18 by another of the beam connectors 30. It is understood that while a second end beam 14 is not shown coupled to the first length beam 16 and the second length beam 18, the second end beam 14 fixedly couples to each of the first length beam 16 and the second length beam 18 by one or more of the beam connectors 30.

Figure 4:
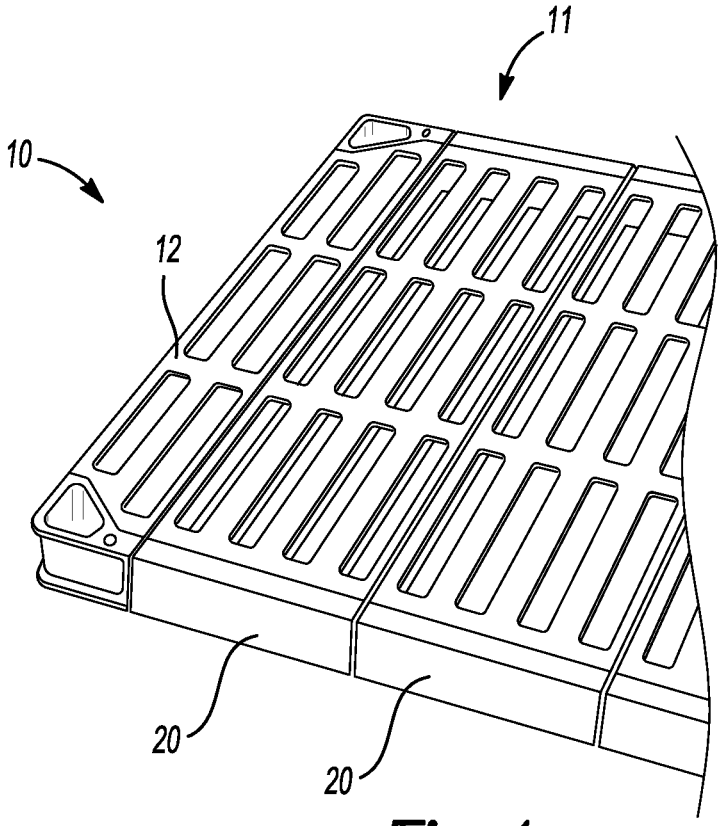
FIG. 4 is a perspective view of an assembled shelf including the shelf frame and shelf mats of FIG. 2.

As illustrated in FIG. 4, the plurality of shelf mats 20 are press fitted to the first length beam 16 and the second length beam 18. The shelf frame 10 is assembled once the first end beam 12 and the second end beam 14 are fixedly coupled to the first length beam 16 and the second length beam 18.

Further, the shelf 11 is assembled once the plurality of shelf mats 20 are press fitted onto the shelf frame 10.

In some implementations, the beam connectors 30 include the first connector portion 32 and the second connector portion 34, as described above. In another implementation, each beam connector 30 may be a single piece beam connector 31, as illustrated in FIGS. 5A through 5D. The single piece beam connectors 31 include similar features as those described with respect to the beam connectors 30. For example, each of the single piece beam connectors 31 includes a first flexible protrusion 38 and a second flexible protrusion 40.

Figure 5A:
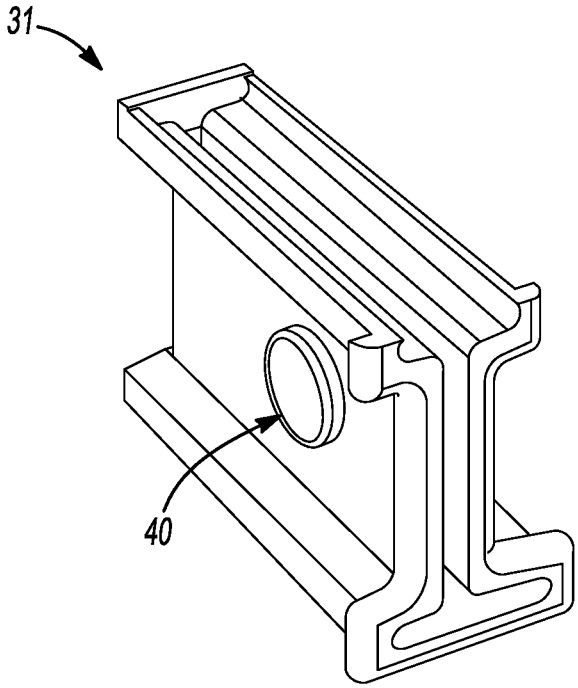
FIG. 5A is a perspective view of an alternative beam connector according to the principles of the present disclosure.
Figure 5B:
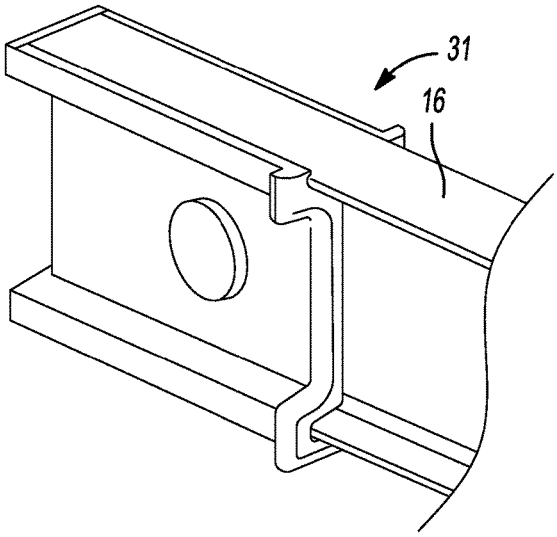
FIG. 5B is an enlarged perspective view showing the alternative beam connector of FIG. 5A assembled to a beam.
Figure 5C:
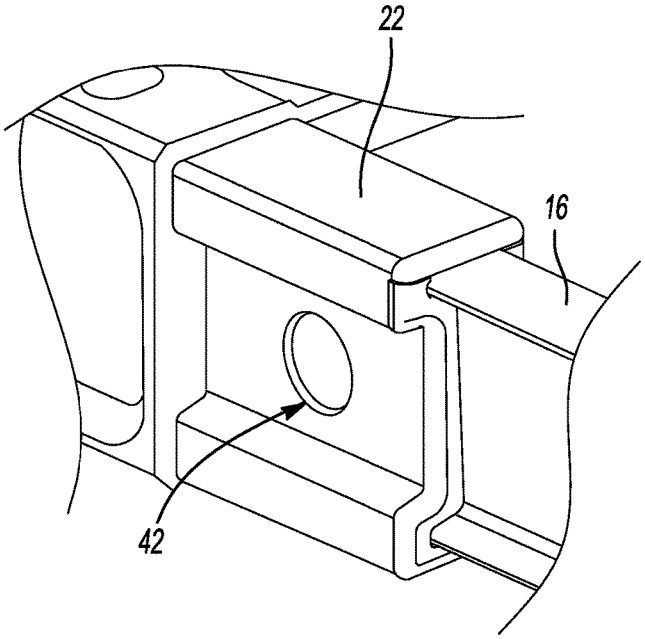
FIG. 5C is an enlarged perspective view showing the alternative beam connector of FIG. 5A in a partially assembled shelf frame.
Figure 5D:
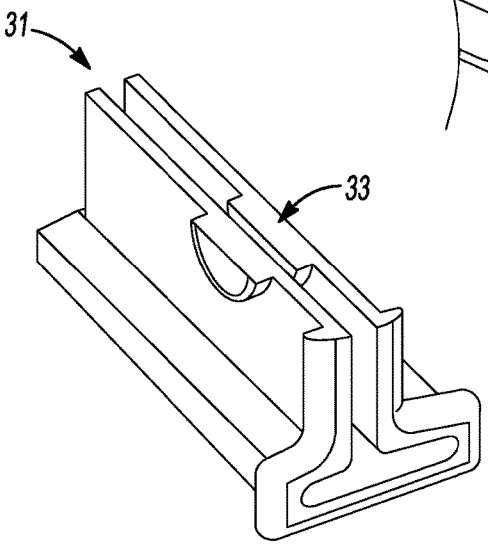
FIG. 5D is a section view of the alternative beam connector of FIG. 5A.

Each of the single piece beam connectors 31 includes an interior beam indexing feature 33 as illustrated in FIG. 5D. In some implementations, the interior beam indexing feature 33 includes similar properties to the first flexible protrusion 38. In this manner, the interior beam indexing feature 33 engages one of the first length beam 16 and the second length beam 18. Further, the interior beam indexing feature 33 prevents the one of the first length beam 16 and the second length beam 18 from withdrawing from the single piece beam connector 31. The single piece beam connectors 31 slidably engage the first length beam 16 and the second length beam 18 at the first end 26 and the second end 28 respectively. The shelf frame 10 and the shelf 11 are then assembled, as described above.

In some implementations, a first predetermined force is applied by a machine to fixedly couple the first end beam 12 and the second end beam 14 to the beam connectors 30. Further, a second predetermined force may be applied by the machine in order to snap the first flexible protrusion 38 into the first receiving portion 36. Further, a third predetermined force may be applied by the machine to press fit the shelf mats 20 onto the first length beam 16 and the second length beam 18. It is understood the first, second, and third predetermined forces may be the same amount of force or a different amount of force. Further, two of the first, second, and third predetermined forces may be the same while the other of the first, second, and third predetermined forces may be a different amount of force.

Figure 6:
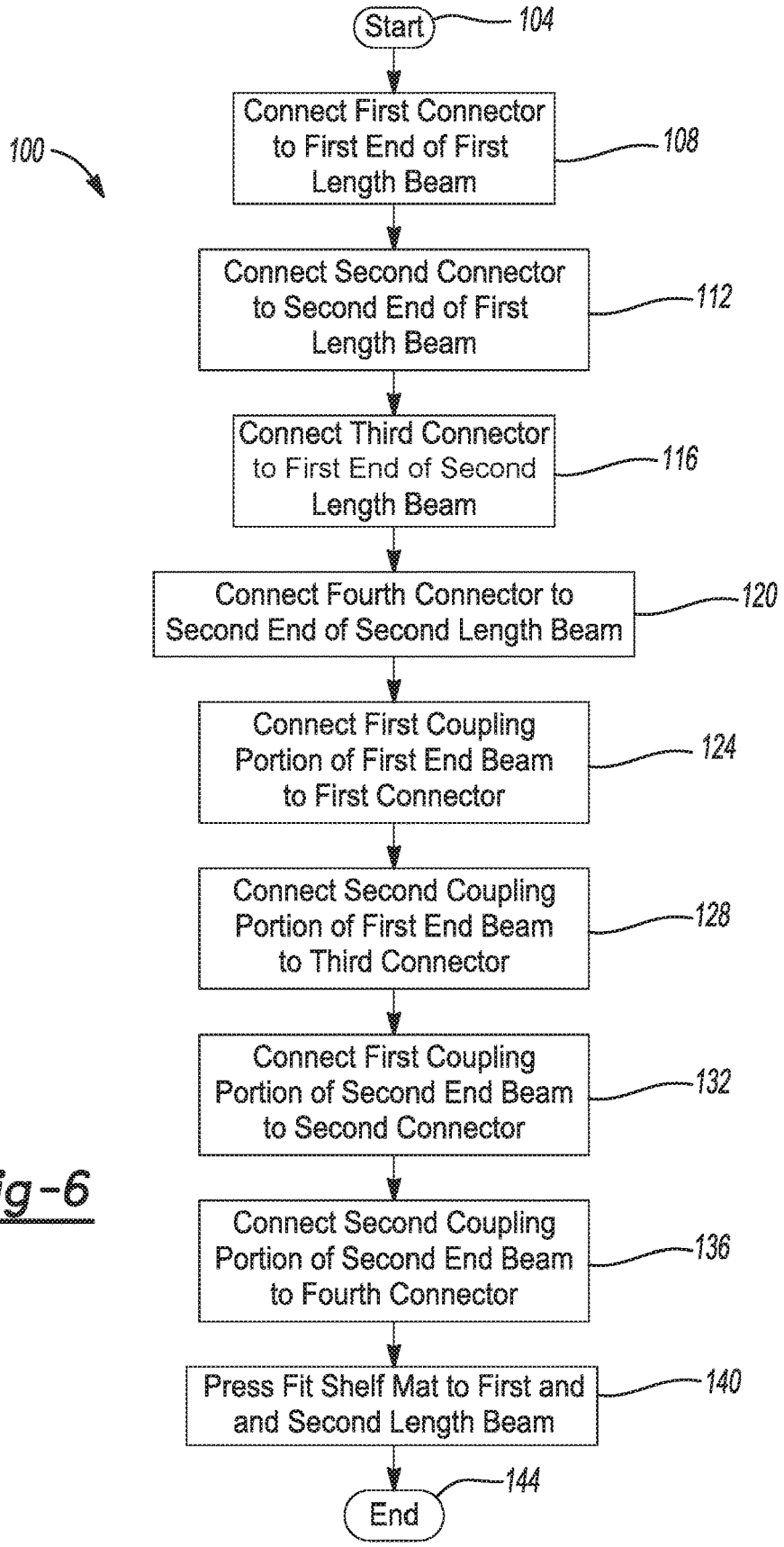
FIG. 6 is a flow diagram illustrating a method for assembling a shelf frame according to the principles of the present disclosure.

With reference to FIG. 6, a method 100 for assembling a shelf starts at 104. At 108, a first beam connector 30 is connected to the first end 26 of the first length beam 16. At 112, a second beam connector 30 is connected to the second end 28 of the first length beam 16. At 116, a third beam connector 30 is connected to the first end 26 of the second length beam 18. At 120, a fourth beam connector 30 is connected to the second end 28 of the second length beam 18. At 124, the first coupling portion 22 of the first end beam 12 is connected to the first beam connector 30. At 128, the second coupling portion 24 of the first end beam 12 is connected to the third beam connector 30. At 132, the first coupling portion 22 of the second end beam 14 is connected to the second beam connector 30. At 136, the second coupling portion 24 of the second end beam 14 is connected to the fourth beam connector 30. At 140, the plurality of shelf mats 20 are press fitted onto the first length beam 16 and the second length beam 18. The method 100 ends at 144.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

What is claimed is:

1. A component of a shelf assembly system, the component comprising:

a beam connector comprising a first portion comprising a first flexible protrusion and a second portion comprising a second flexible protrusion, wherein the first portion is configured to receive the second portion when the first and second portions are assembled;

a length beam including a first receiving portion configured to receive the first flexible protrusion; and an end beam including a coupling portion comprising a proximal end and a distal end, wherein the proximal end is configured to flex away from the beam connector in response to the beam connector being inserted into the coupling portion and a second receiving portion is configured to receive the second flexible protrusion of the beam connector.

2. The component of a shelf assembly system of claim 1, wherein the first receiving portion comprises a hole.

3. The component of a shelf assembly system of claim 1, wherein the proximal end is configured to return to an original position in response to the second flexible protrusion snapping into the second receiving portion.

4. The component of a shelf assembly system of claim 1, further comprising:

a second connection existing between a second end beam and the length beam;

a third connection existing between the second end beam and a second length beam;

a fourth connection existing between the end beam and the second length beam; and a plurality of shelf mats configured to receive each of the length beam and the second length beam.

5. The component of a shelf assembly system of claim 1, wherein the first and second portions of the beam connector are separate pieces.

6. The component of a shelf assembly system of claim 1, wherein the first portion of the beam connector is configured to fit inside of the second portion of the beam connector.

7. The component of a shelf assembly system of claim 1, wherein the first portion of the beam connector fixedly snaps into the second portion of the beam connector.

8. A component of a shelf assembly system, the component comprising:

a beam connector comprising a first portion comprising a first flexible protrusion and a second portion comprising a second flexible protrusion, wherein the first portion is configured to receive the second portion;

a length beam including a first receiving portion configured to receive the first flexible protrusion, wherein the first receiving portion comprises a hole; and an end beam including a coupling portion comprising a proximal end and a distal end, wherein the proximal end is configured to flex away from the beam connector in response to the beam connector being inserted into the coupling portion and a second receiving portion is configured to receive the second flexible protrusion of the beam connector, and wherein the first flexible protrusion snaps into a recess in the second portion of the beam connector on a backside of the second flexible protrusion.

9. A component of a shelf assembly system, the component comprising:

a beam connector comprising a first portion comprising a first flexible protrusion and a second portion comprising a second flexible protrusion, wherein the first portion is configured to receive the second portion when the first and second portions are assembled;

a length beam including a first receiving portion configured to receive the first flexible protrusion; and an end beam including a coupling portion comprising a proximal end and a distal end, wherein a second receiving portion is configured to receive the second flexible protrusion of the beam connector.

10. The component of a shelf assembly system of claim 9, wherein the proximal end is configured to flex away from the beam connector in response to the beam connector being inserted into the coupling portion.

11. The component of a shelf assembly system of claim 10, wherein the proximal end is configured to return to an original position in response to the second flexible protrusion snapping into the second receiving portion.

12. The component of a shelf assembly system of claim 9, further comprising:

a second connection existing between a second end beam and the length beam;

a third connection existing between the second end beam and a second length beam;

a fourth connection existing between the end beam and the second length beam; and a plurality of shelf mats configured to receive each of the length beam and the second length beam.

13. The component of a shelf assembly system of claim 9, wherein the first portion of the beam connector is configured to fit inside of the second portion of the beam connector.

14. The component of a shelf assembly system of claim 9, wherein the first portion of the beam connector fixedly snaps into the second portion of the beam connector.

* * * * *